US005370385A

United States Patent [19]

Joy

[11] Patent Number: 5,370,385

[45] Date of Patent: Dec. 6, 1994

[54] PORTABLE BATTING CAGE

[76] Inventor: B. Michael Joy, 845 Northern Ave., Clarkston, Ga. 30021

[21] Appl. No.: 142,001

[22] Filed: Oct. 28, 1993

[51] Int. Cl.[5] ..... A63B 69/40

[52] U.S. Cl. ..... 273/26 A

[58] Field of Search ..... 273/26 A, 127 R, 127 A, 273/127 B, 127 C, 181 F, 26 R

[56] References Cited

U.S. PATENT DOCUMENTS

| | | | |
|---|---|---|---|
| 2,449,708 | 9/1948 | Lindsay | 273/127 B |
| 2,525,304 | 10/1950 | Lindsay | 273/127 B |
| 3,475,025 | 10/1969 | Uphaus | 273/26 A |

FOREIGN PATENT DOCUMENTS

| | | | |
|---|---|---|---|
| 2847701 | 5/1980 | Germany | 273/127 B |

*Primary Examiner*—Theatrice Brown

*Attorney, Agent, or Firm*—James B. Middleton

[57] ABSTRACT

A batting cage is made up of a base section having a rear wall that hinges to fold in the middle and allow the side walls to be placed adjacent to each other. The upper section can be easily lifted off the lower section; and, the upper section is disassembled into four corner posts and side members, and a top member. The netting to catch balls has clips that easily fix to eyes on the frame of the batting cage. The batting cage can be disassembled and folded, and can be transported in a small van or pick up truck. The cage is fast and easy to assemble for use and to disassemble for transport or storage.

5 Claims, 3 Drawing Sheets

PORTABLE BATTING CAGE

BACKGROUND OF THE INVENTION

1. Field of the Invention

This invention relates generally to sports apparatus, and is more particularly concerned with a cage for confining baseballs and the like.

2. Discussion of the Prior Art

In games such as baseball, softball and the like, it is common for players to utilize a cage or other such confining means to restrict balls that are thrown, for example, to a batter. In practicing for a game, a batter will stand in a particular position while either a person or a machine throws balls repeatedly to the batter. If the batter does not hit the balls, the balls must be retrieved unless there is some retaining means. Thus, one generally has a backstop or cage of some type to restrict the balls thrown to the batter. During a ball game, one also uses some form of backstop both to restrict the balls for the sake of the players, and to protect the spectators from such balls.

It will be understood that, in permanent stadiums designed for baseball or the like, one will generally have a permanently installed backstop to limit the balls to the playing field; however, unless the field is permanently dedicated to baseball and softball, such a backstop may interfere with other uses of the field and not be allowed.

In the past, there have been efforts at providing a batting cage that can be put into place when needed, and removed when not needed. Such batting cages have generally taken the form of a conventional batting cage of the type that might be permanently installed, but instead placed on wheels so the batting cage can in fact be moved from the practice location. While such a batting cage might be called "portable", any portability is limited to the one field since it is totally impractical to move the batting cage from one geographical area to another. Other batting cages that might be called portable include the one shown in U.S. Pat. No. 3,980,304 which is mounted on a large truck. While this device is in fact portable, the batting cage is not removable from the bed of the truck, so it is not usable on existing fields as a normal batting cage. Another portable batting cage is disclosed in U.S. Pat. No. 4,815,736. Again, this device includes an elongated member that cannot be put behind the normal home plate of a baseball diamond, so it cannot be used as a normal backstop or batting cage. Other portable batting cages include lightweight frames that cannot withstand the heavy duty use in a baseball game or the like.

SUMMARY OF THE INVENTION

The present invention provides a portable batting cage that includes a foldable base section and a disassembleable top section. The base section easily folds into a relatively flat package that can be stored in a relatively small space, and can be transported by a small van or pick-up truck or the like. The upper section can be quickly and easily disassembled or assembled; and, when assembled the upper section seats readily into the lower section. A netting is quickly and easily attachable to the frame of the batting cage to complete the cage.

The present invention therefore provides an easily portable and easily storable batting cage that can be completely assembled and ready for use within a few minutes, and can also be disassembled and ready for storage in a few minutes. When assembled for use, the batting cage is comparable to permanently installed batting cages, but can be owned by, for example, a team that practices in numerous different fields.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
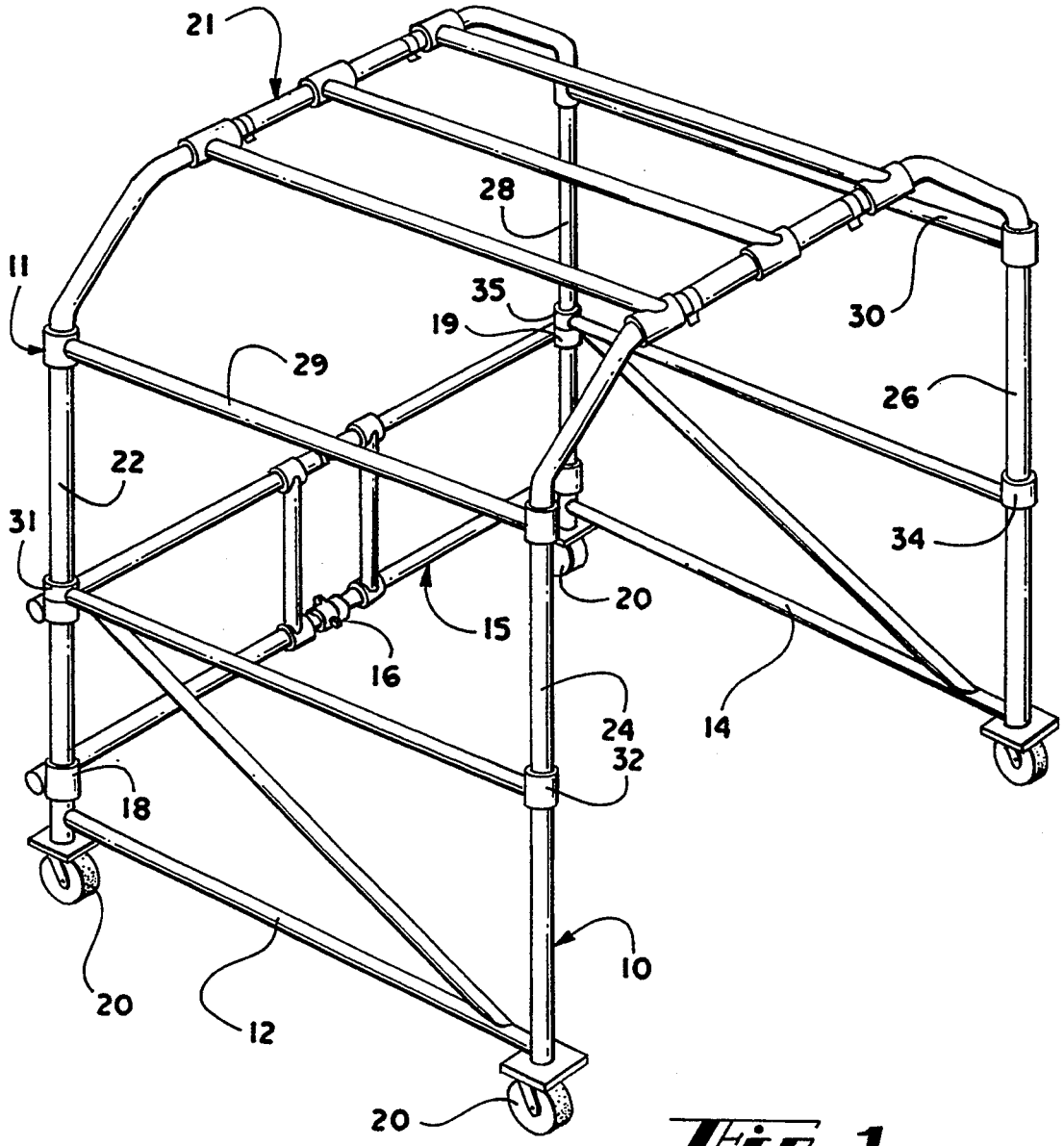
FIG. 1 is a perspective view showing the frame of a batting cage made in accordance with the present invention, the netting being omitted for clarity.

Referring now more particularly to the drawings, and to that embodiment of the invention here presented by way of illustration, the batting cage of the present invention comprises generally a base section 10 and an upper section 11. The base section 10 includes a pair of side walls 12 and 14, and a rear wall 15. The rear wall 15 is hinged in the middle generally at 16, and is pivotally connected to the side walls 12 and 14 at 18 and 19. The base section 10 also includes casters 20 at each of the four corners of the batting cage.

The upper section 11 comprises a top member 21 supported by four corner posts 22, 24, 26 and 28. The posts 22 and 24 are connected by a side connecting member 29 while the posts 26 and 28 are connected by a side connecting member 30.

It will be understood generally that the base section 10 can be folded by breaking the rear wall at 16 and allowing members of the rear wall 15 to pivot at 18 and 19 with respect to the side walls 12 and 14. The upper section 11 is lifted from the base section and disassembled. The upper section is broken into the four corner members and their connecting members, and the top member 21. In this condition, it will be understood that the batting cage can be easily stored in a relatively small space, or the batting cage can be transported by means of a pick-up truck, small van or the like. While the netting is not shown, it will be readily recognized that netting is sufficiently flexible that it can be folded without difficulty.

Figure 2:
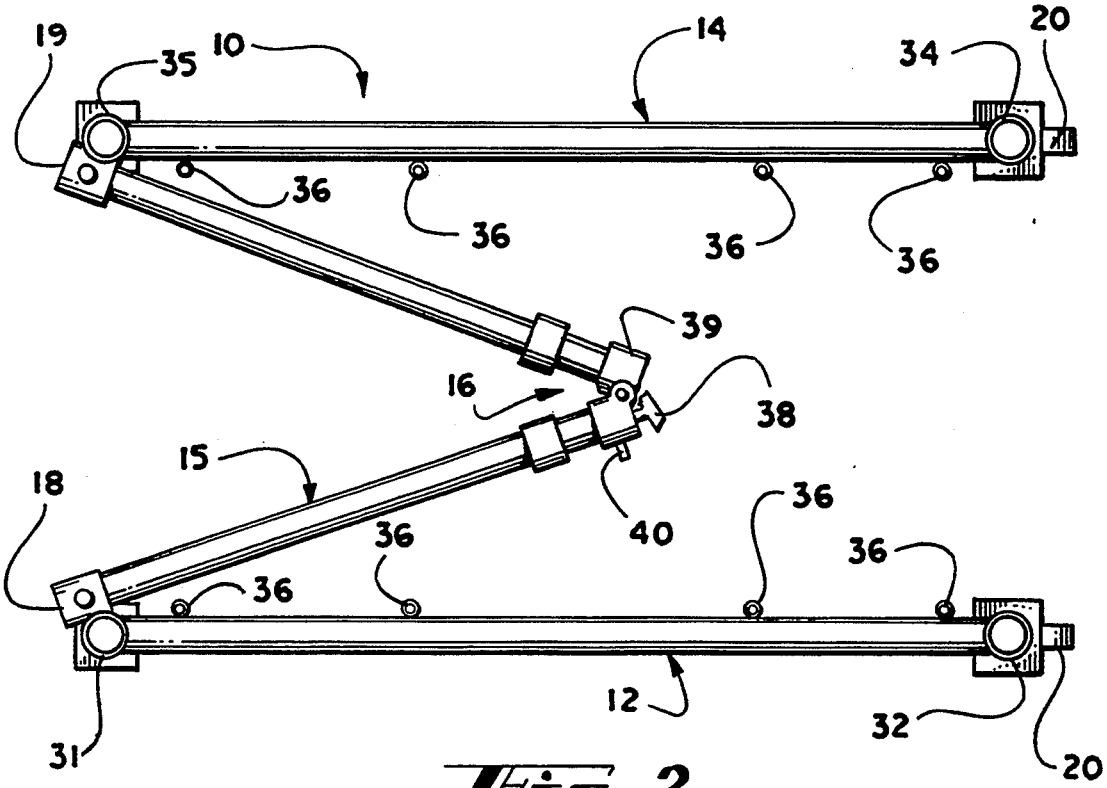
FIG. 2 is a top plan view of the base section shown in FIG. 1, in a partially folded condition.

Looking next at FIG. 2 of the drawings, the base section 10 is illustrated in a partially folded condition. In FIG. 2 it can be seen that the four corners of the base section 10 include sockets 31, 32, 34 and 35. These sockets are adapted to receive the corner posts 22, 24, 26 and 28 of the upper section 11. Also in FIG. 2 it can be seen that the side walls 12 and 14 of the base section 10 include a plurality of eyes 36.

In FIG. 2, the hinge 16 is shown in more detail. It can be seen that the rear wall 15 can be folded in the middle by pivoting of the hinge member 16. When the rear wall 15 is straightened, the latch member 38 will move inwardly, then engage with an opening in the member 39. The connection can be released by pushing inwardly on the button 40. Such an apparatus is well known in the scaffolding industry, and no further description is thought to be necessary. Using the hinge member 16, it will be understood that the rear wall 15 can be straightened as is shown in FIG. 1 of the drawings, and the member will have sufficient strength that there is no danger in inadvertent closing of the base section. Also, the hinge 16 is easily released to allow the base section to be folded as shown somewhat in FIG. 2 of the drawings.

Figure 3:
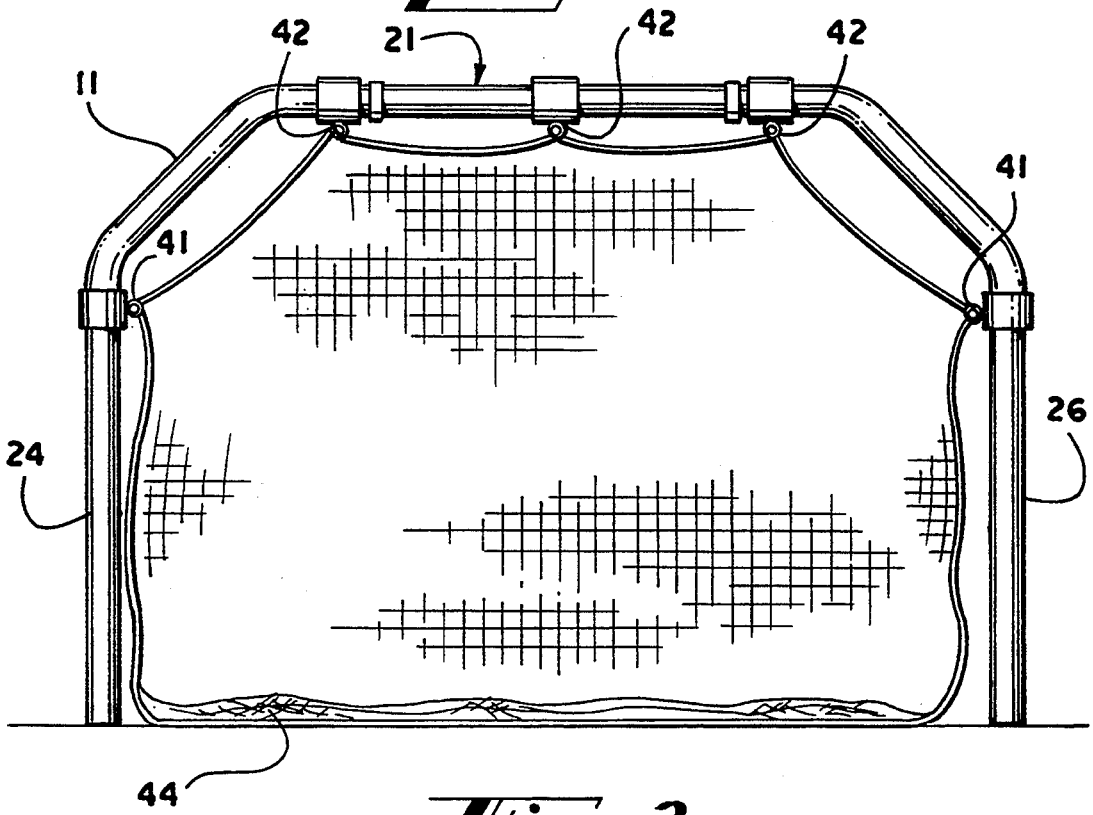
FIG. 3 is a front elevational view of the upper section of the batting cage, assembled with the netting attached.

Referring to FIG. 3 of the drawings, the upper section 11 is illustrated as assembled, and with the netting attached. It will here be seen that the upper section 11 has a plurality of eyes 41 extending from the connecting members 29 and 30, and a plurality of eyes 42 extending downwardly from the top member 21. The netting, which will be preformed to generally the shape of the batting cage frame shown in FIG. 1, can be simply hooked to the eyes 41 and 42.

It will be noted that the netting, generally indicated at 44, is longer than the upper section 11. As will be discussed in more detail hereinafter, the netting will be connected to the upper section 11 before the upper section 11 is placed on the base section 10, and the netting 44 is long enough to extend downwardly to cover the base section 10.

Figure 4:
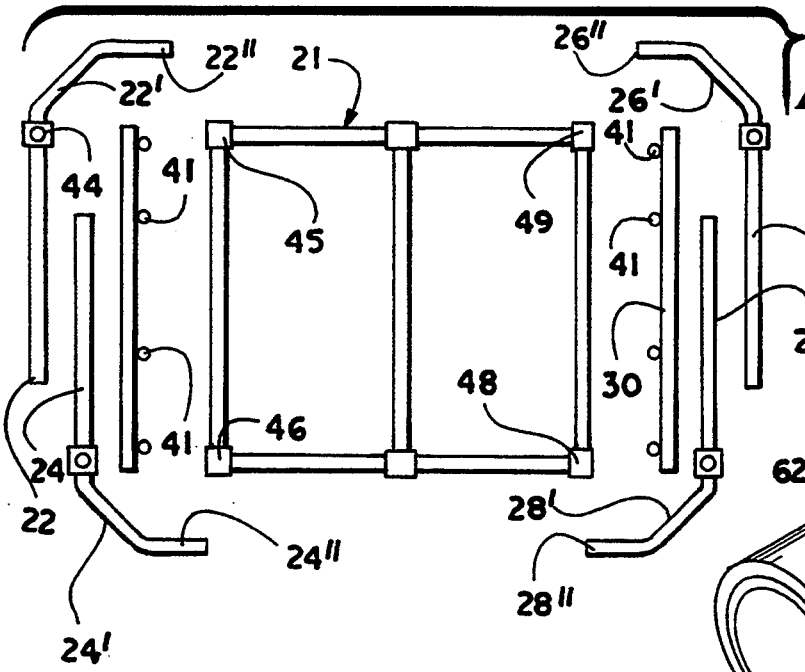
FIG. 4 is a plan view showing the pieces of the upper section disassembled.

Attention is next directed to FIG. 4 which shows the upper section 11 disassembled. It will be seen that the corner posts 22, 24, 26 and 28 include a straight vertical section, then the angled corners such as the corner 22', and a horizontal, straight section 22". Just below the angled portion 22', there is a connector 44 for connection of the side member 29. The corner posts 24, 26 and 28 have comparable connecting means which are the same and will not be discussed in detail. It can also be seen in FIG. 4 that the side members 29 and 30 include eyes 41 extending therefrom.

The top member 21 is here shown as being generally rectangular in shape with a central cross member. It should be understood that, at the four corners, there are sockets 45, 46, 48 and 49 to receive the horizontal members 22", 24", 26" and 28".

From the foregoing description, it should be understood that, in assembling the upper section 11, the top member 21 will be in the condition illustrated in FIG. 4, and one can then connect, for example, the corner posts 26 and 28 using the side member 30. After the two posts are connected, the horizontal members 26" and 28" will be inserted into the sockets 48 and 49 and appropriately fixed as will be discussed later. Next, the vertical members 22 and 24 will be connected by the side member 29, and the horizontal members 22" and 24" will be inserted into the sockets 45 and 46. The upper section 11 is then fully assembled.

Figure 5:
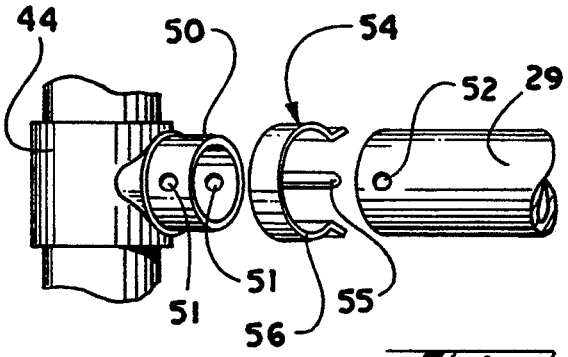
FIG. 5 is an exploded perspective showing the means for attachment of pieces in the upper section.

One of the advantages of the present invention is that the entire device can be assembled or disassembled without the need for any tools. One of the mechanical arrangements that allows the assembly without the use of tools is shown in FIG. 5 of the drawings. It will be understood that the illustration in FIG. 5 is typical of several connections, and the various connections will not be shown in detail. By way of example, FIG. 5 shows the connection of the side member 29 to the vertical member 22 of the upper section 11. It will be seen that the connecting joint 44 on the vertical member 22 includes a nipple 50 having holes 51 diametrically therethrough. The nipple 50 is sized to be received within the side member 29; and, the side member 29 has mating holes 52 diametrically therethrough. Thus, the connecting member 29 can be placed over the nipple 50, and the holes 52 and 51 can be aligned. With the holes aligned, a clip member generally designated at 54 is used to secure the pieces in place. It will be seen that the clip member 54 includes a pin 55 of sufficient size and length to extend through the holes 52 and 51. The clip member 54 also includes a circumferentially extending spring member 56 which engages the side member 29. Since the spring member 56 extends around more than half of the circumference of the side member 29, it will be understood that the clip 54 will not be inadvertently removed. When the clip member 54 is to be removed, it will be readily understood that the ends of the spring member 56 can be urged apart so the pin 55 can be withdrawn from the holes 51 and 52.

It should be understood that this arrangement is utilized in virtually all of the connections to be made in setting up and removing the batting cage of the present invention. This includes, for example, the connections of the four post 22, 24, 26 and 28 to the top member 21, and the connection of the four posts to the base section 10. It will be obvious to those skilled in the art that the same connection system could be used to break down the top member 21 further in the event smaller pieces are required.

Figure 6:
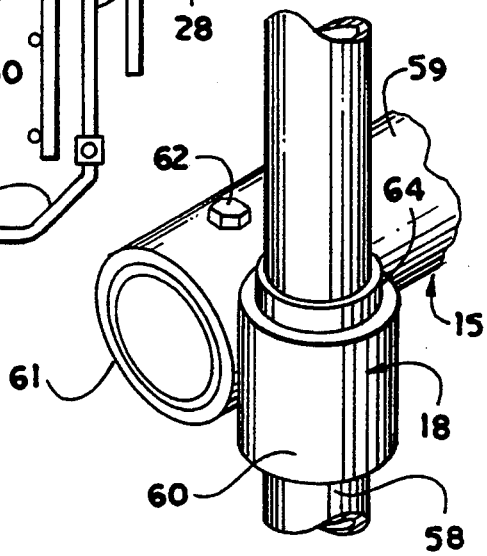
FIG. 6 is a fragmentary perspective showing the pivot means at the side walls of the base section.

While many forms of pivoting means will be readily devised by those skilled in the art for pivoting the rear wall 15 to the side walls 12 and 14 of the base section 10, attention is directed to FIG. 6 of the drawings. In FIG. 6, one of the vertical corner members 58 is illustrated with the bottom rail 59 of the rear wall 15. A collar 60 is rotatably fixed to the corner member 58, the collar 60 having a sleeve 61 fixed thereto. The sleeve 61 receives the member 59 of the rear member 15, and a bolt or the like 62 extends therethrough to secure the pieces together. To limit the movement of the collar 60 along the member 58, there is a band 64 fixed to the member 58.

It will be understood by those skilled in the art that the collar 60 here shown is for the bottom member of the rear wall 15; and, the top member will have a band such as the band 64 beneath the collar rather than above it. The sleeves 60 will therefore be confined for limited movement of the rear wall 15.

Figure 7:
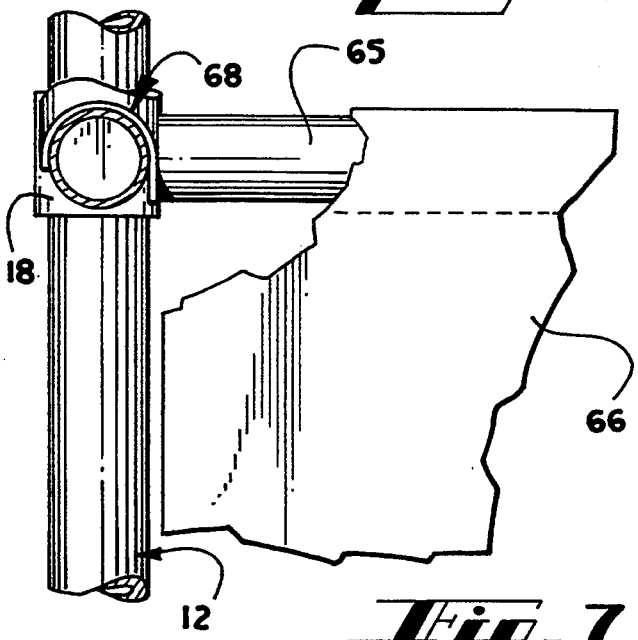
FIG. 7 is a fragmentary view showing attachment of a rear padding member in the batting cage of the present invention; and, FIG. 8 is a fragmentary view showing a means for attachment of the netting to the batting cage.

Looking next at FIG. 7 of the drawings, it will be understood that one generally wishes to have a pad or the like to receive most of the balls that are not hit by the batter. These balls will of course strike relatively low. Thus, it is contemplated in the present invention that the pad will be suspended between the top rails of the base section 10. As shown in FIG. 7, the upper member of the left hand panel 12 use a hook 68 for supporting ends of the transverse member 65. The transverse member 65 has a pad member 66 fixed thereto and depending therefrom.

The hook member generally designated at 68 is arranged simply to hook over the upper member of the side wall 12. Since there will be no forces tending to remove the hook 68 from the upper member, no latch means is required.

Figure 8:
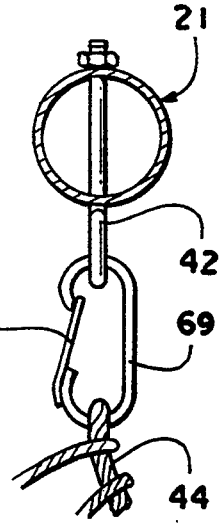

FIG. 8 of the drawings shows the means for connecting the netting to the frame of the batting cage of the present invention. The eyes, such as the eyes 42, have been previously discussed. In FIG. 8, it can be seen that eyes can be installed by extending the shaft of an eye bolt through holes in the frame members, and fixing the shaft by a nut on the opposite side of the frame member. The netting, indicated in FIG. 8 at 44, uses a plurality of hooks 69. Each of the hooks 69 includes a spring member 70 that can be depressed to allow the eye 42 to enter the hook 69. Thus, one can simply grasp the various hooks 69 on the net 44 and engage the hook 69 with the eyes such as the eyes 41, 42 and the like.

With the above discussion in mind, it should now be understood that the batting cage of the present invention will be brought to a location in knocked-down condition with the base section 10 folded as indicated in FIG. 2, and the upper section 11 disassembled as illustrated in FIG. 4 of the drawings. The upper section 11 will assembled as was described above; then, the netting 44 will be attached to the upper section as illustrated in FIG. 3. Once the netting is attached, preferably four people will each grasp one of the corner posts 22, 24, 26 and 28 of the upper section and lift it onto the base section 10. Each of the corner posts will be received by one of the sockets 31, 32, 34 and 35 in the base section. The netting 44 is sufficient that it will extend downwardly generally to the ground with the upper section mounted on the base section. After the upper section has been installed, the netting will be further attached to the base section, and the padding member 66 will be put into place. It will be understood that the assembly takes only a few minutes, and disassembly likewise takes only a few minutes so the batting cage can be erected for use or disassembled for storage or transportation with just a few minutes' effort.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A batting cage comprising a base frame section, an upper frame section and net means, said upper frame section being detachably connected on said base frame section, said base frame section including a rear wall and at least a pair of side walls, each said side wall being pivotably attached to a respective end of said rear wall, said rear wall having hinge means intermediate said ends for allowing folding of said rear wall upon removal of said upper section, whereby said side walls can be disposed substantially parallel to each other and to said rear wall, said net means being selectively attachable to and removable from said base and upper frame sections.

2. A batting cage as claimed in claim 1, wherein said upper section comprises a top member, and corner posts fixed to said top member, said corner posts being selectively detachable from said top member.

3. A batting cage as claimed in claim 2, wherein said base section further includes a plurality of corner posts, each corner post of said plurality of corner posts defining a socket for receiving one of said corner posts of said top section.

4. A batting cage as claimed in claim 2, including clip members for selectively securing said corner posts of said upper section to said top member, said clip members including a pin receivable in diametrically extending holes, and a spring member carrying said pin for fixing said pin to said top member.

5. A batting cage as claimed in claim 1, said net means being generally co-extensive with said batting cage, said batting cage further including a plurality of eyes carried by said top member, said side walls and said rear wall, and a plurality of clips carried by said net means and selectively fixable to said eyes for selectively securing said net means to said batting cage.

* * * * *